US011415013B1

(12) United States Patent
Whittle et al.

(10) Patent No.: US 11,415,013 B1
(45) Date of Patent: Aug. 16, 2022

(54) CERAMIC MATRIX COMPOSITE VANE WITH INTEGRATED PLATFORM JOINT

(71) Applicant: Rolls-Royce plc, London (GB)

(72) Inventors: Michael J. Whittle, London (GB); Laurie Bootle, London (GB)

(73) Assignee: Rolls-Royce plc

( * ) Notice: Subject to any disclaimer, the term of this patent is extended or adjusted under 35 U.S.C. 154(b) by 0 days.

(21) Appl. No.: 17/491,472

(22) Filed: Sep. 30, 2021

(51) Int. Cl.
*F03B 1/00* (2006.01)
*F01D 9/04* (2006.01)

(52) U.S. Cl.
CPC ..... *F01D 9/041* (2013.01); *F05D 2220/32* (2013.01)

(58) Field of Classification Search
CPC ..... F05D 2220/323; F05D 2220/36; F04D 19/002; F04D 29/544; F01D 5/146; F02K 3/06
USPC ..... 415/208.1
See application file for complete search history.

(56) References Cited

U.S. PATENT DOCUMENTS

| | | | | |
|---|---|---|---|---|
| 6,648,597 | B1 * | 11/2003 | Widrig | F01D 9/044 415/200 |
| 9,803,486 | B2 * | 10/2017 | Freeman | F01D 5/288 |
| 2015/0003989 | A1 * | 1/2015 | Uskert | F01D 5/147 416/220 R |
| 2019/0338660 | A1 * | 11/2019 | Underwood | F01D 9/041 |
| 2020/0378267 | A1 * | 12/2020 | Shinavski | F01D 9/041 |

* cited by examiner

*Primary Examiner* — Long T Tran
*Assistant Examiner* — James J Kim
(74) *Attorney, Agent, or Firm* — Barnes & Thornburg LLP

(57) ABSTRACT

An integral, one-piece ceramic matrix composite turbine vane adapted for use in a gas turbine engine includes an airfoil and two platforms. The airfoil extends radially relative to an axis of the gas turbine engine between the first platform and the second platform. The platforms extend circumferentially partway about the axis of the gas turbine engine.

12 Claims, 6 Drawing Sheets

CERAMIC MATRIX COMPOSITE VANE WITH INTEGRATED PLATFORM JOINT

FIELD OF THE DISCLOSURE

The present disclosure relates generally to vanes used in gas turbine engines, and more specifically to vanes incorporating ceramic matrix composite materials.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Compressors and turbines typically include alternating stages of static vane assemblies and rotating wheel assemblies. The rotating wheel assemblies include disks carrying blades around their outer edges. When the rotating wheel assemblies turn, tips of the blades move along blade tracks included in static shrouds that are arranged around the rotating wheel assemblies. Such static shrouds may be coupled to an engine case that surrounds the compressor, the combustor, and the turbine.

Products of the combustion reaction directed into the turbine flow over airfoils included in stationary vanes and rotating blades of the turbine. The interaction of combustion products with the airfoils heats the airfoils to temperatures that cause the airfoils to be made from high-temperature resistant materials and/or to be actively cooled by supplying relatively cool air to the vanes and blades. To this end, some airfoils for vanes and blades are incorporating composite materials adapted to withstand very high temperatures. Design and manufacture of vanes and blades from composite materials presents challenges because of the geometry and strength desired for their application.

SUMMARY

The present disclosure may comprise one or more of the following features and combinations thereof.

A turbine vane adapted for use in a gas turbine engine may include a vane core tube, a vane cover overwrap, and a platform insert. Each of the vane core tube, the vane cover overwrap, and the platform insert may comprise ceramic matrix composite materials.

In some embodiments, the vane core tube may extend radially relative to an axis of the gas turbine engine. The vane core tube may be shaped to include a recess. The recess may extend into an outer surface of the vane core tube.

In some embodiments, the vane cover overwrap may extend around the outer surface of the vane core tube. The vane cover overwrap may extend around the outer surface of the vane core tube to form an outermost surface of the vane.

In some embodiments, the platform insert may include a platform wall, a platform mount, and a platform joint. The platform wall may extend circumferentially partway about the axis to define a first boundary of a gas path of the gas turbine engine. The platform mount may extend radially inward and radially outward away from the platform wall.

The platform joint may extend between and interconnect the platform wall and the platform mount In some embodiments, the platform mount may be located in the recess formed in the vane core tube to form a joint therebetween. The vane cover overwrap may extend over the platform mount and the platform joint so as to interconnect the platform and the vane core tube and strengthen the joint between the vane core tube and the platform unit.

In some embodiments, the platform insert may be a three-dimensional woven ceramic structure. The three-dimensional woven ceramic structure may eliminate filler material in the platform joint.

In some embodiments, the platform mount may include a radially outward mount portion and a radially inward mount portion. The radially outward mount portion may extend radially outward form the platform wall to an outer terminal end. The radially inward mount portion may extend radially inward form the platform wall to form an inner terminal end. The outer terminal end and the inner terminal end may engage the vane core tube in the recess.

In some embodiments, the platform mount may include an inner mount surface. The inner mount surface may extend radially between the outer and inner terminal ends.

In some embodiments, the outer and inner terminal ends may each be defined by an end surface. The end surfaces may each extend at an angle relative to the inner mount surface of the platform mount.

In some embodiments, the vane cover overwrap may include an outer vane cover ply and an inner vane cover ply. The outer vane cover ply may extend around the vane core tube radially outward of the platform wall and over the radially outward mount portion of the platform mount and the platform joint. The inner vane cover ply may extend around the vane core tube radially inward of the platform wall and over the radially inward mount portion of the platform mount and the platform joint.

In some embodiments, the turbine vane may further include an outer platform cover ply and an inner platform cover ply. The outer platform cover ply may engage a first surface of the platform wall. The inner platform cover ply may engage a second surface of the platform wall. The second surface of the platform wall may be opposite the first surface.

In some embodiments, the platform insert may include a plurality of two-dimensional ceramic laminate layers. The plurality of two-dimensional ceramic layers may each form a portion of the platform wall, the platform mount, and the platform joint.

In some embodiments, the platform mount may include a radially outward mount portion and a radially inward mount portion. The radially outward mount portion may extend radially outward form the platform wall to an outer terminal end. The radially inward mount portion may extend radially inward form the platform wall to form an inner terminal end. The outer terminal end and the inner terminal end may engage the vane core tube in the recess.

According to another aspect of the present disclosure, a turbine vane may include a vane core tube, a vane cover overwrap, and a platform insert. The vane core tube, the vane cover overwrap, and the platform insert may each comprise ceramic matrix composite materials.

In some embodiments, the vane core tube may extend radially relative to an axis of the gas turbine engine. The vane core tube may be shaped to include a recess that extends into an outer surface of the vane core tube. In some embodiments, the vane cover overwrap may extend around the outer surface of the vane core tube.

In some embodiments, the platform insert may include a platform wall, a platform mount, and a platform joint. The platform wall may extend circumferentially partway about the axis. The platform mount may extend radially away from the platform wall. The platform joint may extend between and interconnect the platform wall and the platform mount.

In some embodiments, the platform mount may be located in the recess formed in the vane core tube to form a joint therebetween. The vane cover overwrap may extend over the platform mount and the platform joint.

In some embodiments, the platform insert may be a three-dimensional woven ceramic structure. The structure may eliminate filler material in the platform joint.

In some embodiments, the platform mount may include a radially outward mount portion and a radially inward mount portion. The radially outward mount portion may extend radially outward form the platform wall to an outer terminal end. The radially inward mount portion may extend radially inward form the platform wall to form an inner terminal end. The outer terminal end and the inner terminal end may engage the vane core tube in the recess.

In some embodiments, the platform mount may include an inner mount surface and an outer mount surface. The inner mount surface may extend radially between the outer and inner terminal ends.

In some embodiments, the outer and inner terminal ends may each be defined by an end surface. The end surfaces may each extend at an angle relative to the inner mount surface of the platform mount.

These and other features of the present disclosure will become more apparent from the following description of the illustrative embodiments.

DETAILED DESCRIPTION OF THE DRAWINGS

Figure 1:
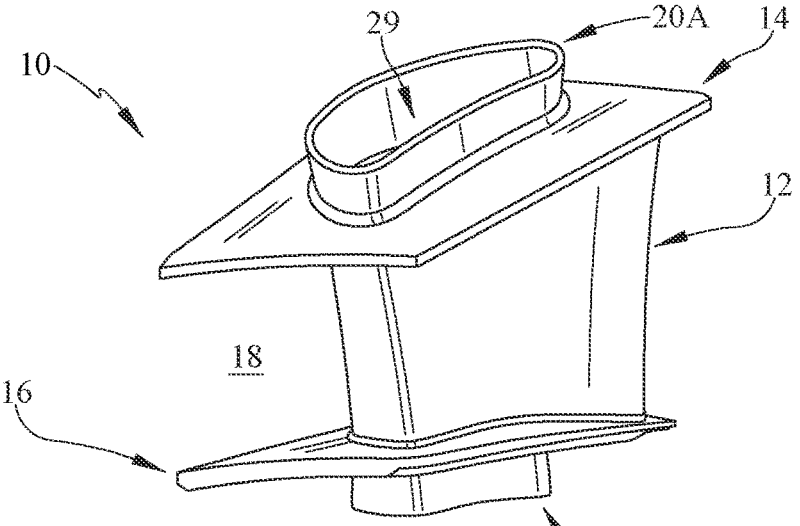
FIG. 1 is a perspective view of a turbine vane made of ceramic matrix composite material for use in a gas turbine engine showing that the vane is an integrated component that includes an airfoil that extends radially relative to an axis of the gas turbine engine and is shaped to redirect air moving through a primary gas path in the gas turbine engine and two platforms that extend circumferentially partway about the axis to define a inner and outer boundaries of the gas path of the gas turbine engine.

For the purposes of promoting an understanding of the principles of the disclosure, reference will now be made to a number of illustrative embodiments illustrated in the drawings and specific language will be used to describe the same.

Figure 2:
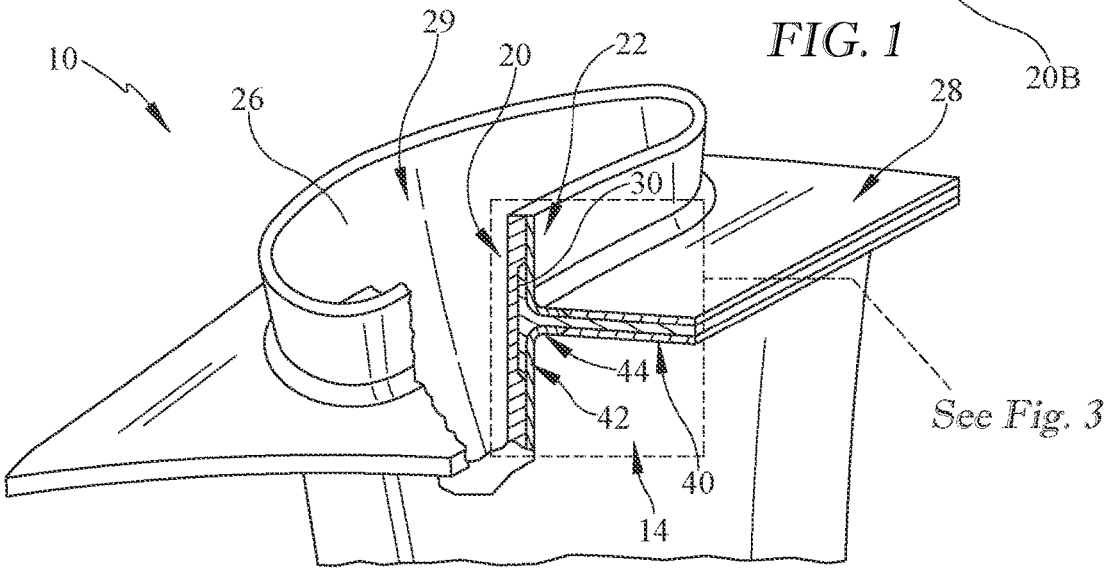
FIG. 2 is a detail view of the turbine vane of FIG. 1 showing a portion of the vane broken away to show the different components of the airfoil and the platform that together form an integral, one-piece turbine vane.

An integral, one-piece ceramic matrix composite turbine vane 10 adapted for use in a gas turbine engine is shown illustratively in FIG. 1. The turbine vane 10 includes an airfoil 12, a first platform 14, and a second platform 16 as shown in FIGS. 1 and 2. The airfoil 12 extends radially relative to an axis of the gas turbine engine between the first platform 14 and the second platform 16. The airfoil 12 is adapted to interact with gases flowing through a gas path 18 of the gas turbine engine. The platforms 14, 16 extend circumferentially partway about the axis of the gas turbine engine to define inner and outer boundaries of the gas path of the gas turbine engine.

The airfoil 12 includes a vane core tube 20 and a vane cover overwrap 22 as shown in FIGS. 2-5. The vane core tube 20 is shaped to include recesses 30, 32 that each extend into an outer surface 24 of the vane core tube 20. The vane cover overwrap 22 is arranged around the outer surface 24 of the vane core tube 20 so as to provide an outermost surface of the airfoil 12.

The platforms 14, 16, or sometimes referred to as the platform inserts 14, 16, each include a platform wall 40, 46 and a platform mount 42, 48 as shown in FIGS. 2-5. The platform wall 40, 46 extends circumferentially partway about the axis to define the boundary of the gas path. The platform mount 42, 48 extends radially inward and radially outward away from the platform wall 40, 46.

The vane core tube 20 and the vane cover overwrap 22 of the airfoil 12 and the platform inserts 14, 16 all comprise ceramic matrix composite materials and come together to form one integral, single-piece turbine vane 10 as shown in FIG. 1. The vane core tube 20 extends radially through each of the platform inserts 14, 16 so that the platform mount 42, 48 is located in the corresponding recess 30, 30. This interface between the airfoil 12 and each platform inserts 14, 16 forms a joint therebetween.

The inset of the platform mount 42, 48 included in each of the platform inserts 14, 16 in the recess 30, 30 reinforces and strengthens the joint between the airfoil 12 and the platform inserts 14, 16. The vane cover overwrap 22 is arranged around the vane core tube 20 and the platform mount 42, 48 so as to hold the platform mount 42, 48 in place relative to the vane core tube 20. Once assembled, the vane core tube 20, the vane cover overwrap 22, and the platform 14, 16 are infiltrated with matrix material to create one integral single piece turbine vane 10 with increased strength at the joints between the airfoil 12 and the platform inserts 14, 16.

The ceramic matrix composite materials forming the turbine vane 10 include a plurality of plies and/or preforms with ceramic-containing fibers in the illustrative embodiment. The plurality of plies and/or preforms are laid-up relative to one another and then infiltrated with ceramic matrix material to integrate the airfoil 12, the first platform 14, and the second platform 16 with one another and form a single, integral, one-piece ceramic matrix composite turbine vane 10. The plurality of plies and/or preforms are shaped to reinforce the joints between the airfoil units and the platforms.

In the illustrative embodiment, the platform inserts 14, 16 are three-dimensional woven structures that further include a platform joint 44, 50 as shown in FIGS. 2-5. The platform joint 44, 50 extends between and interconnects the corresponding platform wall 40, 46 and the corresponding platform mount 42, 48. The platform joints 44, 50 create smooth transition sections or fillets 52, 54 between the corresponding platform wall 40, 46 and the corresponding platform mount 42, 48 thereby eliminating the use of filler material in the joint between the airfoil 12 and the platform inserts 14, 16.

Each of the platform mounts 42, 48 of the platform inserts 14, 16 are substantially similar and only the first platform mount 42 is described further. However, description of the first platform mount 42 applies to the second platform mount 48 as will be understood.

Figure 5:
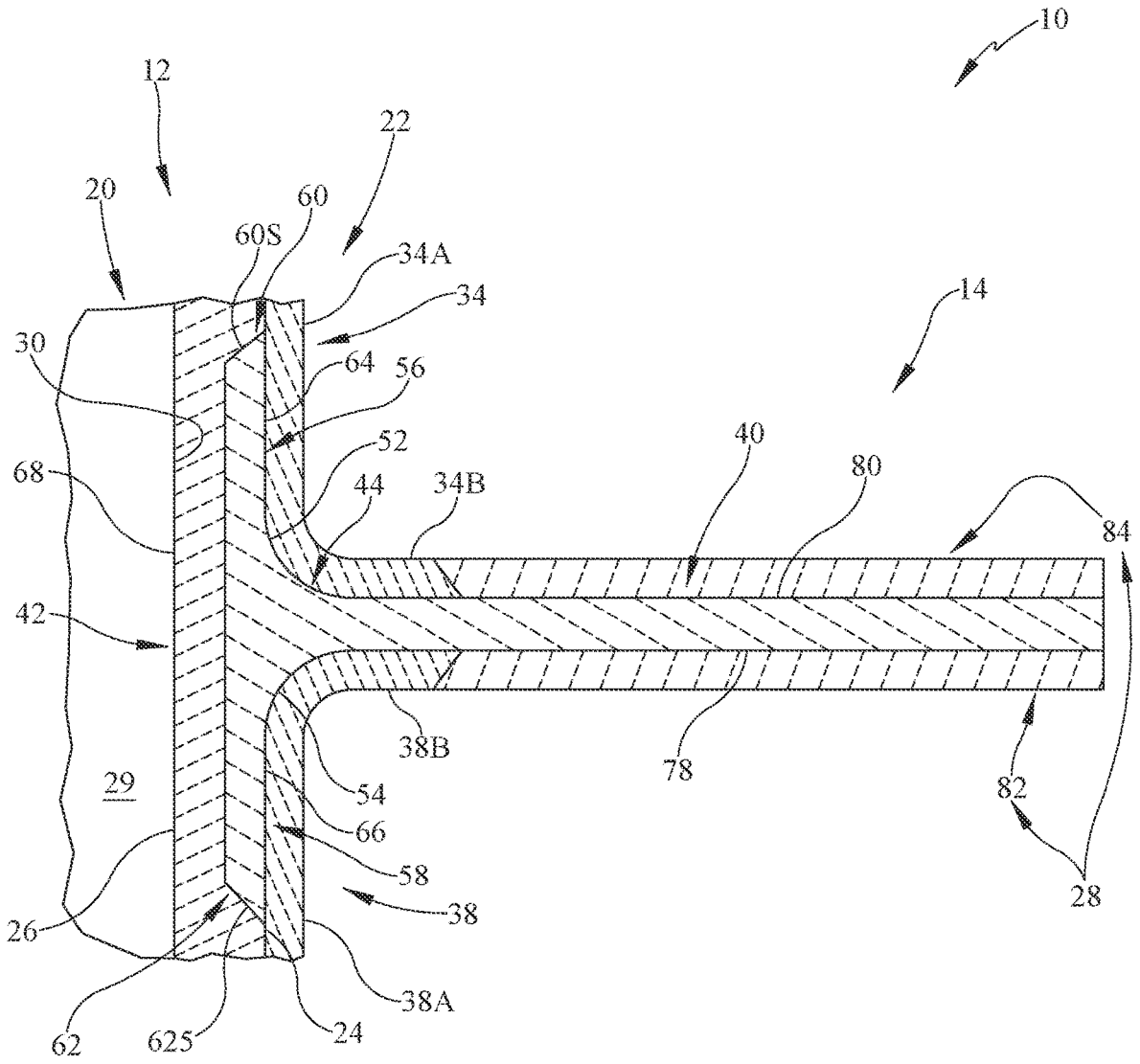
FIG. 5 is a view similar to FIG. 3 showing the vane cover overwrap extends over the platform mount and the platform joint so as to interconnect the platform and the vane core tube and strengthen the joint between the vane core tube and the platform, and further showing the turbine vane includes outer and inner platform cover plies that extend over the platform wall of the platform.

In the illustrative embodiment, the platform mount 42 includes a radially outward portion 56 and a radially inward portion 58 as shown in FIG. 5. The radially outward portion 56 extends radially outward relative to the platform wall 40 to an outer terminal end 60. The radially inward portion 58 extends radially inward relative to the platform wall 40 opposite the radially outward portion 56 to an inner terminal end 62. The outer terminal end 60 and the inner terminal end 62 engage the vane core tube 20 in the corresponding recess 30, 32 as shown in FIG. 5.

Figure 4:
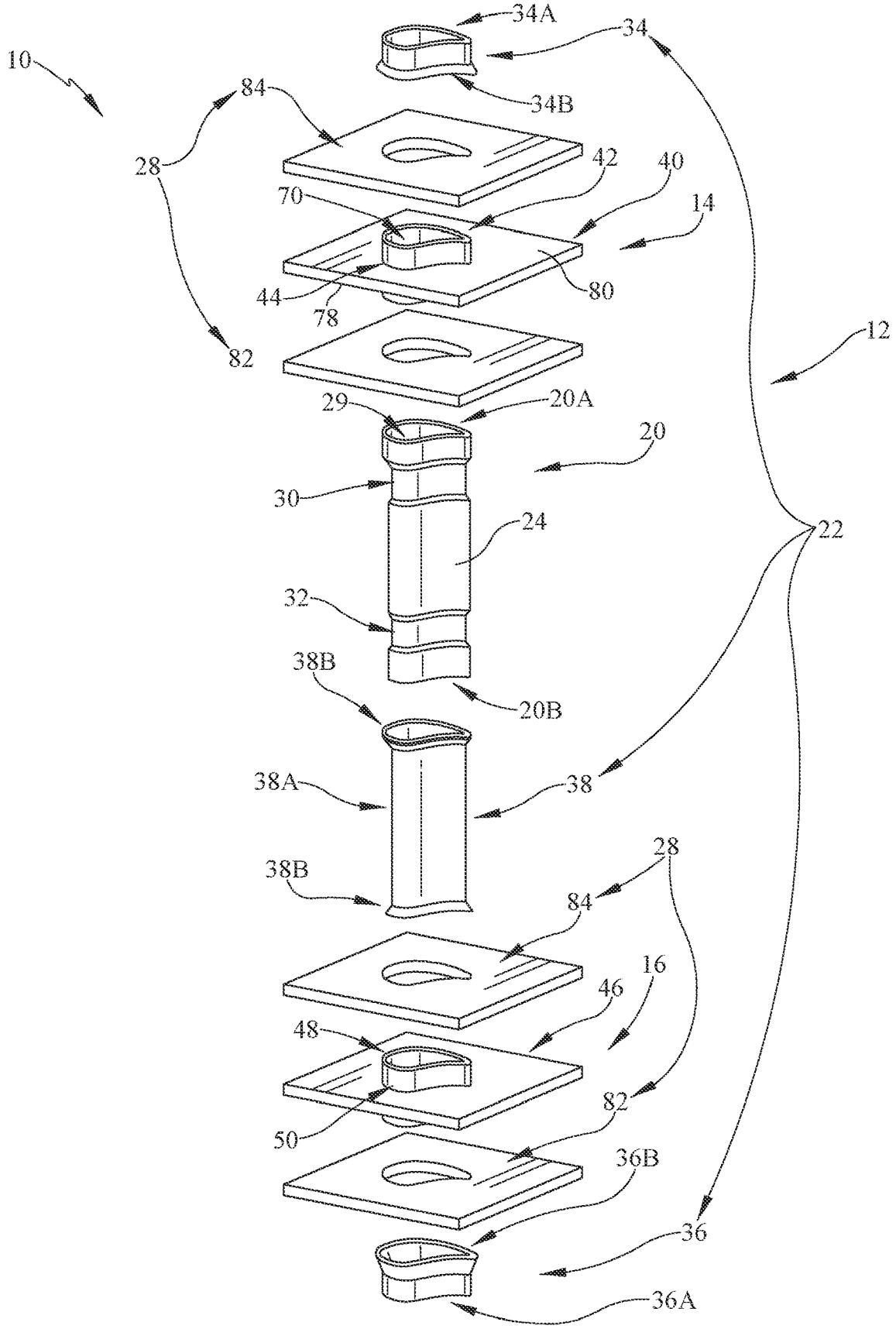
FIG. 4 is an exploded view of the turbine vane of FIG. 1 showing the vane core tube includes a recess that is configured to receive the platform mount of the platform to form a joint therebetween.

The radially outward portion 56 and the radially inward portion 58 are also each shaped to define an outer mount surface 64, 66 and an inner mount surface 68 as shown in FIG. 5. The radially outward portion 56 defines the outer mount surface 64 and the radially inward portion 58 defines the outer mount surface 66. The inner mount surface 68 is opposite the outer mount surfaces 64, 66 and defines a hole 70 that extends radially through the platform 14 as shown in FIG. 4. The inner mount surface 68 faces the corresponding recess 30.

The outer terminal end 60 of the radially outward portion 56 is defined by a surface 60S that extends between the outer mount surface 64 and the inner mount surface 68. The inner terminal end 62 of the radially inward portion 58 is defined by a surface 62S that extends between the outer mount surface 66 and the inner mount surface 68. Both surfaces 60S, 62S extend at an angle relative to the outer mount surfaces 64, 66 and the inner mount surface 68.

The vane core tube 20 extends through the hole 70 in the platform 14 so that the platform mount 42 is located in the recess 30 of the vane core tube 20. The platform mount 42 is inset into the recess 30 so that the outer mount surfaces 64, 66 are flush with the outer surface 24 of the vane core tube 20. The inner mount surface 68 and the terminal end surfaces 60S, 62S of the platform mount 42 engaged the recess 30 of the vane core tube 20.

Turning again to the airfoil 12, the vane core tube 20 extends radially between an outer end 20A and an inner end 20B as shown in FIGS. 1 and 4. The vane core tube 20 includes the outer surface 24, an inner surface 26, and the recesses 30, 32 as shown in FIGS. 2-5. The inner surface 26 defines a passageway 29 that extends radially through the vane core tube 20. The outer surface 24 is opposite the inner surface 26. The recesses 30, 32 extend into the outer surface 24 adjacent to the outer and inner ends 20A, 20B of the vane core tube 20.

The vane core tube 20 includes a first recess 30 and a second recess 32 as shown in FIGS. 2-5. The first recess 30 is adjacent the outer radial end 20A of the vane core tube 20, while the second recess 32 is adjacent the inner radial end 20B of the vane core tube 20 in the illustrative embodiment. The platform mount 42 of the first platform 14 is located in the first recess 30 and the platform mount 48 of the second platform 16 is located in the second recess 32.

Figure 3:
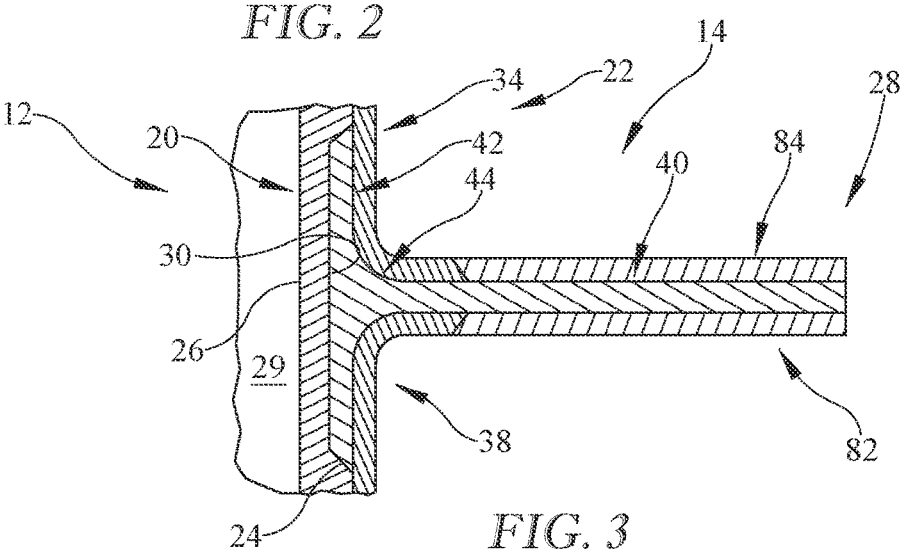
FIG. 3 is a detail view of the turbine vane of FIG. 2 showing the airfoil includes an vane core tube and a vane cover overwrap that extends around an outer surface of the vane core tube and showing the platform is a three-dimensionally woven structure including a platform wall, a platform mount that extends radially inward and radially outward away from the platform wall, and a platform joint that extends between and interconnects the platform wall and the platform mount.

The vane cover overwrap 22 includes a first vane cover ply 34, a second vane cover ply 36, and a third cover ply 38 as shown in FIGS. 3-5. The first vane cover ply 34 is arranged around the radially outward portion 56 of the first platform mount 42. The second cover ply 36 is arranged around a portion of the second platform mount 48. The third vane cover ply 38 is arranged around the radially inward portion 58 of the first platform mount 42 and a portion of the second platform mount 48.

In the illustrative embodiment, the vane cover plies 34, 36, 38 form an outermost surface of the vane 10. In some embodiments, the outermost surface is a gas path surface within the primary gas path 18. The gas path surface is adapted to interact with gases flowing through the gas path 18 of the gas turbine engine. In the illustrative embodiment, the third cover ply 38 of the vane cover overwrap 22 defines a portion of the gas path 18.

Each of the vane cover plies 34, 36, 38 includes an airfoil portion 34A, 36A, 38A and a transition portion 34B, 36B, 38B as shown in FIGS. 4 and 5. The airfoil portions 34A, 36A, 38A extend radially along the vane core tube 20. The transition portions 34B, 36B, 38B extend from the corresponding airfoil portions 34A, 36A, 38A and circumferentially along the platform joint 44, 50.

The first cover ply 34 includes the airfoil portion 34A and the transition portion 34B as shown in FIGS. 4 and 5. The airfoil portion 34A extends along the vane core tube 20 and the outer mount surface 72 of the radially outward portion 56 of the first platform mount 42. The transition portion 34B extends from the airfoil portion 34A and along the platform joint 44 of the platform 14.

The second cover ply 36 includes the airfoil portion 36A and the transition portion 36B as shown in FIG. 4. The airfoil portion 36A extends along the vane core tube 20 and a portion of the second platform mount 48. The transition portion 36B extends from the airfoil portion 36A and along the platform joint 50 of the platform 16.

The third cover ply 38 includes the airfoil portion 38A and the transition portions 36B as shown in FIGS. 4 and 5. The airfoil portion 38A extends along the vane core tube 20, the outer mount surface 72 of the radially inward portion 58 of the first platform mount 42, and a portion of the second platform mount 48. The transition portions 38B extend from the airfoil portion 38A on either end and along the platform joint 44, 50 of the each of the platform inserts 14, 16.

In the illustrative embodiment, the vane 10 further includes a platform cover overwrap 28 as shown in FIGS. 3-5. The platform cover overwrap 28 has platform cover plies 82, 84 that cooperate with the vane cover plies 34, 36, 38 to define the outermost surface of the vane 10.

Turning again to the platform inserts 14, 16, each of the platform inserts 14, 16 includes the platform wall 40, 46, the platform mount 42, 48, and the platform joint 44, 50 as shown in FIGS. 4 and 5. The platform wall 40, 46 extends circumferentially partway about the axis to define the boundary of the gas path 18. The platform mount 42, 48 extends radially inward and radially outward away from the platform wall 40, 46. The platform joint 44, 50 extends between and interconnects the corresponding platform wall 40, 46 and the corresponding platform mount 42, 48.

The platform wall 40 includes a first surface 78 and a second surface 80 as shown in FIGS. 4 and 5. The first surface 78 faces the gas path 18, while the second surface 80 is opposite the first surface 78. The platform joints 44, 50 create smooth transition sections or fillets 52, 54 between the surfaces 78, 80 and the outer mount surfaces 64, 66 of the platform mount 42.

In the illustrative embodiment, the inner platform ply 82 engages the first surface 78 of the platform wall 40. The outer platform ply 84 engages the second surface 80 of the platform wall 40. The inner and outer platforms plies 82, 84 define the outermost surface of the platform of the vane 10.

Figure 6:
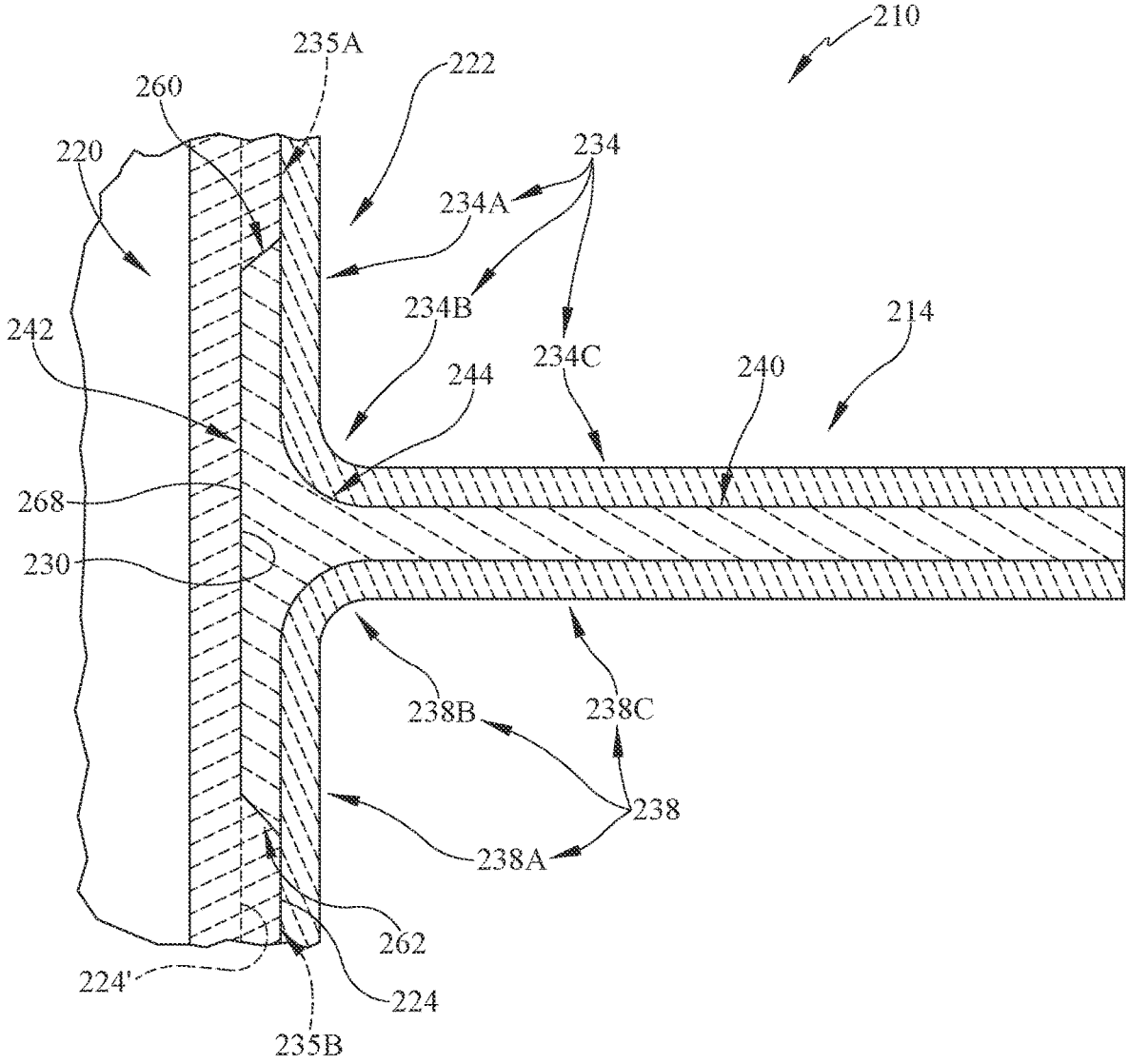
FIG. 6 is another embodiment of a turbine vane similar to the turbine vane of FIG. 1 showing the vane cover overwrap extends over the platform mount, the platform joint, and the platform wall so as to interconnect the platform and the vane core tube and strengthen the joint therebetween.

Another embodiment of a turbine vane 210 in accordance with the present disclosure is shown in FIG. 6. The turbine vane 210 is substantially similar to the turbine vane 10 shown in FIGS. 1-5 and described herein. Accordingly, similar reference numbers in the 200 series indicate features that are common between the turbine vane 10 and the turbine vane 210. The description of the turbine vane 10 is incorporated by reference to apply to the turbine vane 210, except in instances when it conflicts with the specific description and the drawings of the turbine vane 210.

The vane 210 is substantially similar to the vane 10 in FIGS. 1-5 except the vane cover overwrap 222 includes different vane cover plies 234, 238 with an airfoil portion 234A, 238A, a transition portion 234B, 238B, and a platform portion 234C, 238C as shown in FIG. 6. The airfoil portions 234A, 238A extend radially along the vane core tube 220 and the platform mount 242. The transition portions 234B, 238B extend from the corresponding airfoil portions 234A, 238A and circumferentially along the platform joint 244 of the platform insert 214. The platform portions 234C, 238C extend from the corresponding transition portions 234B, 238B and circumferentially along the entire length of the platform wall 240.

The platform portions 234C, 238C replace the platform cover overwrap 28 in the embodiment of FIGS. 1-5. Instead, the vane cover overwrap 222 forms the entire outermost surface of the vane 210.

In some embodiments, the recess 230 may be formed by the vane core tube 220 and an intermediate vane cover overwrap 235A, 235B as suggested in FIG. 6. In such embodiments, the dotted line 224' may form the outer surface 224' of the vane core tube 220 and the intermediate vane cover overwrap 235A, 235B may extend along a portion of the outer surface 224' to form the recess 230.

A first portion of the intermediate vane cover overwrap 235A extends along a portion of the outer surface 224', while a second portion 235B spaced apart radially from the first portion 235A extends along another portion of the outer surface 224'. The first and second portions 235A, 235B then form the original outer surface 224 of the vane core tube 220.

If the recess 230 is formed by the vane core tube 220 and the intermediate vane cover overwrap 235A, 235B, the first portion 235A may engage an outer terminal end 260 of the platform mount 242 and the second portion 235 may engage an inner terminal end 262 of the platform mount 242 as suggested in FIG. 6. The inner mount surface 268 extends between the outer and inner terminal ends 260, 262 and engages the vane core tube 220.

In such embodiments, the vane cover overwrap 222 then extends over the outer surface 224 of what would be the intermediate vane cover overwrap 235A, 235B to secure the platform mount 242 in the recess 230. In other embodiments, the vane cover overwrap 222 may be omitted.

Figure 7:
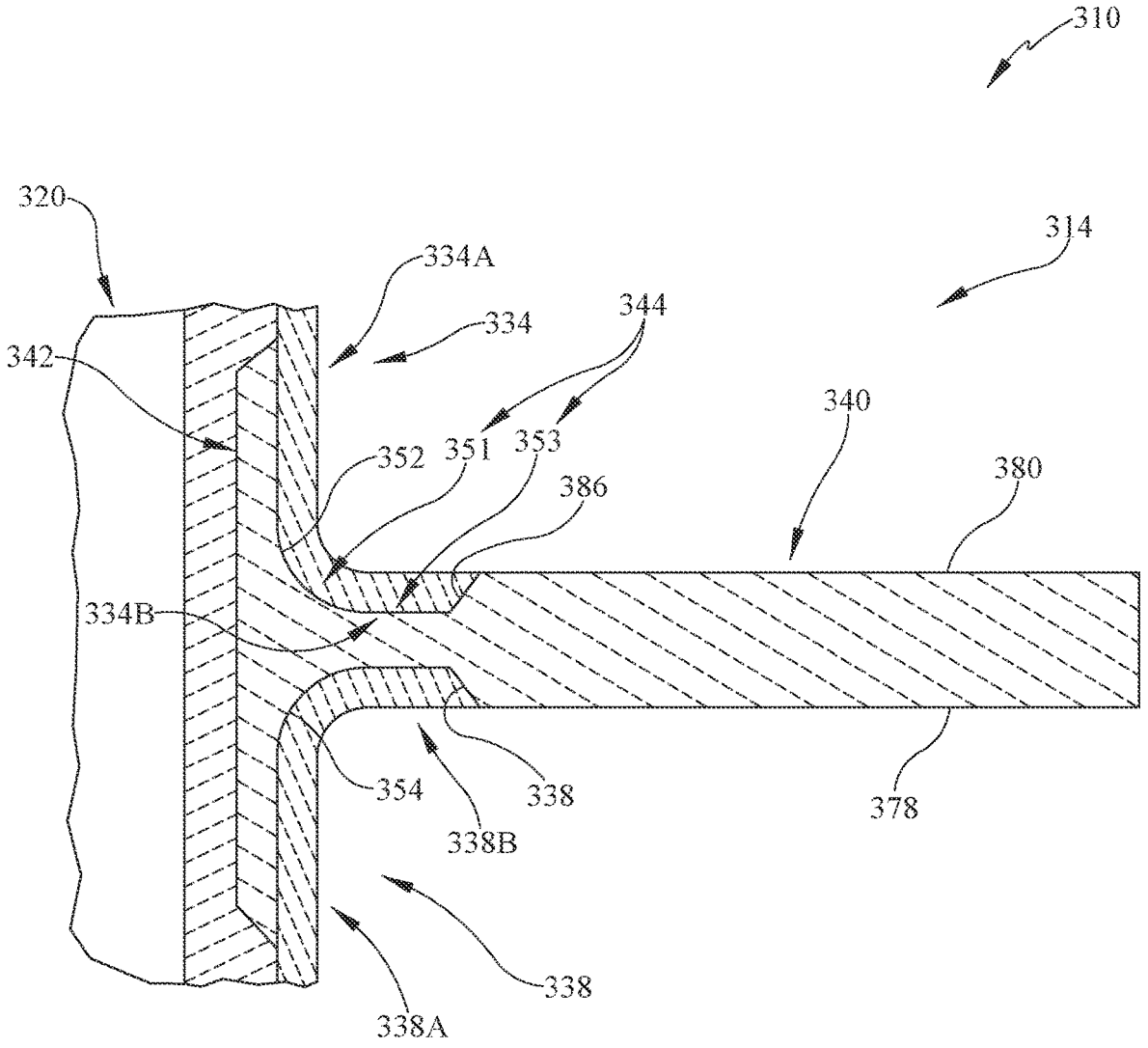
FIG. 7 is another embodiment of a turbine vane similar to the turbine vane of FIG. 1 showing the outer and inner platform cover plies are part of the three-dimensional woven structure of the platform insert and the vane cover overwrap extends over the platform mount and the platform joint and confronts lips formed on the platform wall.

Another embodiment of a turbine vane 310 in accordance with the present disclosure is shown in FIG. 7. The turbine vane 310 is substantially similar to the turbine vane 10 shown in FIGS. 1-5 and described herein. Accordingly, similar reference numbers in the 300 series indicate features that are common between the turbine vane 10 and the turbine vane 310. The description of the turbine vane 10 is incorporated by reference to apply to the turbine vane 310, except in instances when it conflicts with the specific description and the drawings of the turbine vane 310.

The vane 310 is substantially similar to the vane 10 in FIGS. 1-5 except the surfaces 378, 380 of the platform wall 340 form the outermost surface of the platform 314 of the vane 310. The platform wall 340 is shaped to define outer and inner lips 386, 388 that and contacted by the vane cover plies 334, 338 as shown in FIG. 7.

In the illustrative embodiment, the platform insert 314 includes the platform wall 340, a platform mount 342, and a platform joint 344 as shown in FIG. 7. The platform wall 340 extends circumferentially partway about the axis to define the boundary of the gas path 18. The platform mount 342 extends radially inward and radially outward away from the platform wall 340. The platform joint 344 extends between and interconnects the platform wall 340 and the platform mount 342. The platform joint 344 creates transition sections or fillets 352, 354 between the platform wall 340 and the corresponding platform mount 342 thereby eliminating the use of filler material in the joint between the vane core tube 320 and the platform insert 314.

The platform joint 344 has a fillet section 351 and a transition section 353 as shown in FIG. 7. The transition section 353 extends between and interconnects the platform wall 340 and the fillet section 351. The fillet section 351 extends between and interconnects the transition section 353 and the platform mount 342.

The different vane cover plies 334, 338 each include an airfoil portion 334A, 338A and a transition portion 334B, 338B as shown in FIG. 7. The airfoil portions 334A, 338A extend radially along the vane core tube 320. The transition portions 334B, 338B extend from the corresponding airfoil portions 334A, 338A and circumferentially along the fillet section 351 and the transition section 353 of the platform joint 344.

The transition portion 334B, 338B of the vane cover plies 334, 338 confront the lips 386, 388 of the platform wall 340. The outermost surface of the vane cover plies 334, 338 is flush with the surfaces 378, 380 of the platform wall 340.

Figure 8:
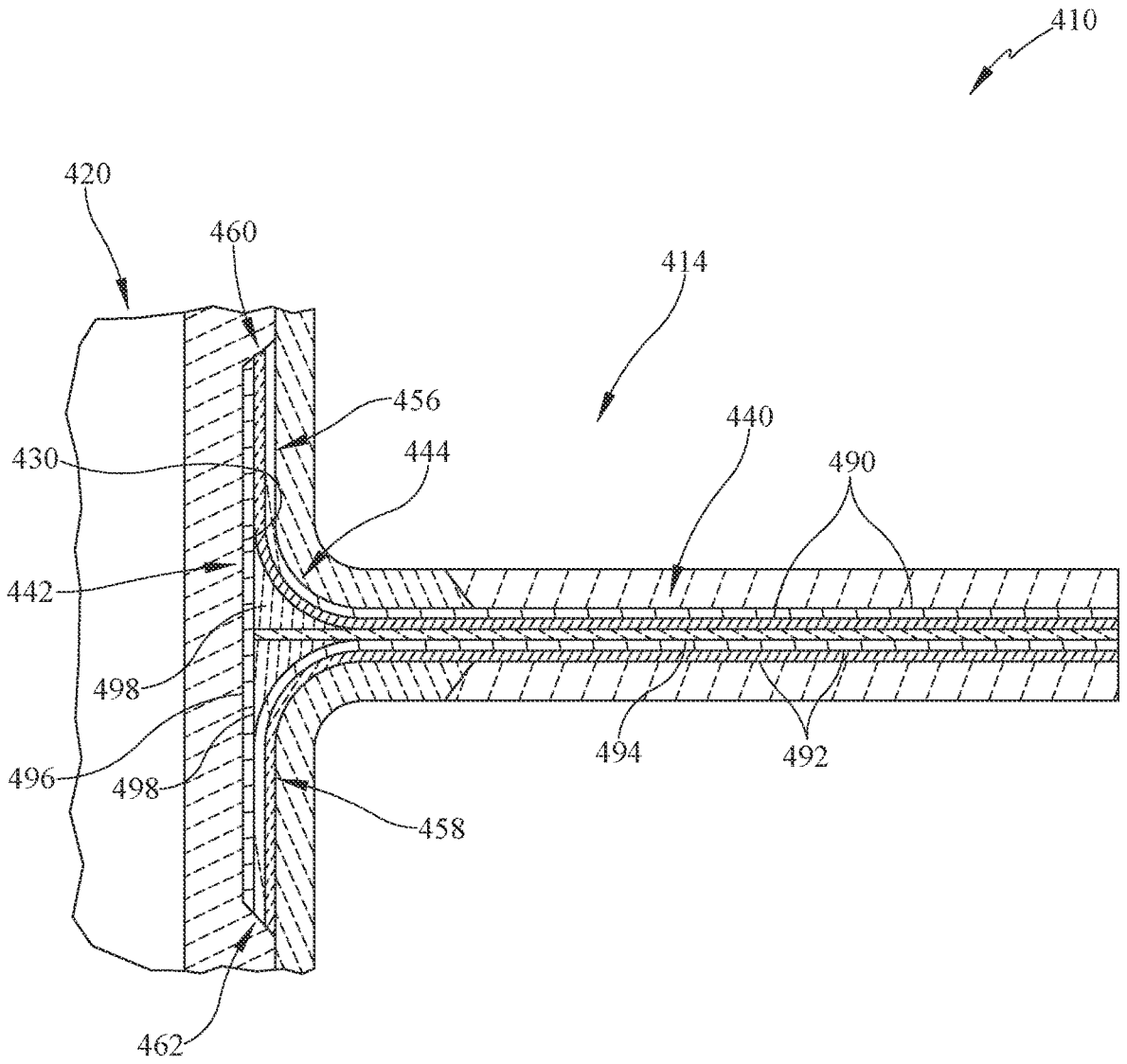
FIG. 8 is another embodiment of a turbine vane similar to the turbine vane of FIG. 1 showing the platform comprises a plurality of two-dimensional ceramic laminate layers the define the platform mount and the platform wall.

Another embodiment of a turbine vane 410 in accordance with the present disclosure is shown in FIG. 8. The turbine vane 410 is substantially similar to the turbine vane 10 shown in FIGS. 1-5 and described herein. Accordingly, similar reference numbers in the 400 series indicate features that are common between the turbine vane 10 and the turbine vane 410. The description of the turbine vane 10 is incorporated by reference to apply to the turbine vane 410, except in instances when it conflicts with the specific description and the drawings of the turbine vane 410.

The vane 410 is substantially similar to the vane 10 in FIGS. 1-5 except the platform insert 414 comprises a plurality of two-dimensional layers and filler material as shown in FIG. 8. The platform insert 414 includes a platform wall 440, a platform mount 442, and a platform joint 344 as shown in FIG. 8. The platform wall 440 extends circumferentially partway about the axis to define the boundary of the gas path 18. The platform mount 442 extends radially inward and radially outward away from the platform wall 440. The platform joint 444 extends between and interconnects the platform wall 440 and the platform mount 442.

Some of the plurality of two-dimensional layers 490, 492 form a portion the platform wall 440, a portion the platform mount 442, and a portion of the platform joint 444 as shown in FIG. 8. Other layers 494, 496 only form a portion of the platform wall 440 or a portion of the platform mount 442. The filler material 498 forms the other portion of the platform joint 444.

In the illustrative embodiment, the platform mount 442 includes a radially outward portion 456 and a radially inward portion 458 as shown in FIG. 8. The radially outward portion 456 extends radially outward relative to the platform wall 440 to an outer terminal end 460. The radially inward portion 458 extends radially inward relative to the platform wall 440 opposite the radially outward portion 456 to an inner terminal end 462. The outer terminal end 460 and the inner terminal end 462 engage the vane core tube 420 in the corresponding recess 430 as shown in FIG. 8.

Some of the plurality of two-dimensional layers 490 form a portion of the radially outward portion 456, while some of the plurality of two-dimensional layers 492 form the radially inward portion 458 as shown in FIG. 8. Both terminal ends 460, 462 of the platform mount 442 engaged the recess 430 of the vane core tube 420.

The present disclosure teaches a method of constructing a ceramic matrix composite vane 10. The vane 10 includes a platform piece 14, 16 that is inset into the recess 30, 32 of the central tube 20 and held captive by an overwrap 22. The inset platform method may be applied to three-dimensional construction to create the platform 14, 16 as shown in FIGS. 1-7. In some embodiments, two-dimensional construction may be used to form the platform joints as shown in FIG. 8.

The three-dimensional woven structure 14, 16 may reduce the number of sub-laminate interfaces to remove possible damage initiation locations in comparison to two-dimensional construction methods. The platform 14, 16 also allows the "Deltoid" type filler parts to be removed thereby reducing uncertainty in material properties in key locations.

The two-dimensional platform insert 414 may increase structural rigidity and strength at typical peak stress locations. The platform 414 may also provide greater control of fibre volume fraction in radii regions through tailoring where the sub laminates terminate. In this way, variation of fibre volume fraction through the material thickness may be reduced.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine vane adapted for use in a gas turbine engine, the turbine vane comprising a vane core tube comprising ceramic matrix composite materials, the vane core tube extending radially relative to an axis of the gas turbine engine and shaped to include a recess that extends into an outer surface of the vane core tube, a vane cover overwrap comprising ceramic matrix composite materials, the vane cover overwrap extending around the outer surface of the vane core tube to form an outermost surface of the vane, and a platform insert comprising ceramic matrix composite materials, the platform insert including (i) a platform wall that extends circumferentially partway about the axis to define a first boundary of a gas path of the gas turbine engine, (ii) a platform mount that extends radially inward and radially outward away from the platform wall, and (iii) a platform joint that extends between and interconnects the platform wall and the platform mount wherein the platform mount is located in the recess formed in the vane core tube to form a joint therebetween and the vane cover overwrap extends over the platform mount and the platform joint so as to interconnect the platform insert and the vane core tube and strengthen the joint between the vane core tube and the platform insert.

2. The turbine vane of claim 1, wherein the platform insert is a three-dimensional woven ceramic structure that eliminates filler material in the platform joint.

3. The turbine vane of claim 2, wherein the platform mount includes a radially outward mount portion that extends radially outward form the platform wall to an outer terminal end and a radially inward mount portion that extends radially inward form the platform wall to form an inner terminal end, the outer terminal end and the inner terminal end engage the vane core tube in the recess.

4. The turbine vane of claim 3, wherein the platform mount includes an inner mount surface that extends radially between the outer and inner terminal ends, the outer and inner terminal ends are each defined by an end surface, and the end surfaces each extend at an angle relative to the inner mount surface of the platform mount.

5. The turbine vane of claim 3, wherein the vane cover overwrap includes (i) an outer vane cover ply that extends around the vane core tube radially outward of the platform wall and over the radially outward mount portion of the platform mount and the platform joint and (ii) an inner vane cover ply that extends around the vane core tube radially inward of the platform wall and over the radially inward mount portion of the platform mount and the platform joint.

6. The turbine vane of claim 5, further comprising an outer platform cover ply that engages a first surface of the platform wall and an inner platform cover ply that engages a second surface of the platform wall opposite the first surface.

7. The turbine vane of claim 1, wherein the platform insert includes a plurality of two-dimensional ceramic laminate layers that each form a portion of the platform wall, the platform mount, and the platform joint.

8. The turbine vane of claim 7, wherein the platform mount includes a radially outward mount portion that extends radially outward form the platform wall to an outer terminal end and a radially inward mount portion that extends radially inward form the platform wall to form an inner terminal end, the outer terminal end and the inner terminal end engage the vane core tube in the recess.

9. A turbine vane comprising a vane core tube comprising ceramic matrix composite materials, the vane core tube extending radially relative to an axis of the gas turbine engine and shaped to include a recess that extends into an outer surface of the vane core tube, a vane cover overwrap comprising ceramic matrix composite materials, the vane cover overwrap extending around the outer surface of the vane core tube, and a platform insert comprising ceramic matrix composite materials, the platform insert including (i) a platform wall that extends circumferentially partway about the axis, (ii) a platform mount that extends radially away from the platform wall, and (iii) a platform joint that extends between and interconnects the platform wall and the platform mount, wherein the platform mount is located in the recess formed in the vane core tube to form a joint therebetween and the vane cover overwrap extends over the platform mount and the platform joint.

10. The turbine vane of claim 9, wherein the platform insert is a three-dimensional woven ceramic structure that eliminates filler material in the platform joint.

11. The turbine vane of claim 10, wherein the platform mount includes a radially outward mount portion that extends radially outward form the platform wall to an outer terminal end and a radially inward mount portion that extends radially inward form the platform wall to form an inner terminal end, the outer terminal end and the inner terminal end engage the vane core tube in the recess.

12. The turbine vane of claim 11, wherein the platform mount includes an inner mount surface that extends radially between the outer and inner terminal ends, the outer and inner terminal ends are each defined by an end surface, and the end surfaces each extend at an angle relative to the inner mount surface of the platform mount.

* * * * *